US006592004B2

(12) United States Patent
Huang et al.

(10) Patent No.: US 6,592,004 B2
(45) Date of Patent: Jul. 15, 2003

(54) FLEXIBLE ORIFICE FOR WET WIPES DISPENSER

(75) Inventors: Yung Hsiang Huang, Appleton, WI (US); Timothy Walter Shoaf, Appleton, WI (US); Robert Samuel Schlaupitz, New London, WI (US); Gerald Keith Sosalla, Appleton, WI (US); Paige Annette Dellerman, Appleton, WI (US); Stephen Robert Kehn, Appleton, WI (US); James Ronald Bath, Appleton, WI (US); Rodney Carlton Christianson, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/870,814

(22) Filed: May 31, 2001

(65) Prior Publication Data

US 2002/0179626 A1 Dec. 5, 2002

(51) Int. Cl.[7] ..... B65H 1/00
(52) U.S. Cl. ..... 221/63; 221/307
(58) Field of Search ..... 221/33, 45, 46, 221/63, 52, 303, 307; 206/233, 494, 812, 409, 449

(56) References Cited

U.S. PATENT DOCUMENTS

| | | | | |
|---|---|---|---|---|
| 2,004,614 A | | 6/1935 | Meagher | |
| 2,840,266 A | | 6/1958 | Nelson | |
| 2,840,267 A | * | 6/1958 | Nelson | 221/48 |
| 3,095,991 A | | 7/1963 | Paniagua | |
| 3,239,097 A | | 3/1966 | Bates et al. | |
| 3,369,699 A | | 2/1968 | Enloe et al. | |
| 3,749,296 A | | 7/1973 | Harrison | |

(List continued on next page.)

FOREIGN PATENT DOCUMENTS

| | | |
|---|---|---|
| EP | 0 068 722 B1 | 4/1988 |

(List continued on next page.)

OTHER PUBLICATIONS

Patent Cooperation Treaty Search Report from the International Search Authority, International Application No. PCT/US 02/16995 dated Apr. 11, 2002.

American Society for Testing Materials (ASTM) Designation: B 395–95, "Standard Specification for U–Bend Seamless Copper and Copper Alloy Heat Exchanger and Condenser Tubes," pp. 535–543, published Oct. 1995.

American Society for Testing Materials (ASTM) Designation: D 412–98A, "Standard Test Methods for Vulcanized Rubber and Thermoplastic Elastomers—Tension," pp. 43–55, published Aug. 1998.

(List continued on next page.)

*Primary Examiner*—Kenneth W. Noland
(74) *Attorney, Agent, or Firm*—Michael J. Bendel

(57) ABSTRACT

The invention relates to a flexible orifice for pop-up style dispensing with a wet wipes dispenser. The orifice includes a flexible, rubber-like sheet having a top surface and a bottom surface. A continuous slit extends across the top and bottom surfaces of the sheet and enables a wet wipe to pass from the bottom surface to the top surface or from the top surface to the bottom surface. The continuous slit has at least one curved portion connected with at least one non-curved portion.

37 Claims, 7 Drawing Sheets

U.S. PATENT DOCUMENTS

| | | | | |
|---|---|---|---|---|
| 3,780,908 | A | | 12/1973 | Fitzpatrick et al. |
| 3,795,355 | A | | 3/1974 | Gerstein |
| 3,836,044 | A | | 9/1974 | Tilp et al. |
| 3,868,052 | A | | 2/1975 | Rockefeller |
| 3,979,019 | A | | 9/1976 | Bliss |
| 3,982,659 | A | | 9/1976 | Ross |
| 3,986,479 | A | | 10/1976 | Bonk |
| 3,994,417 | A | | 11/1976 | Boedecker |
| 4,004,687 | A | | 1/1977 | Boone |
| 4,017,002 | A | | 4/1977 | Doyle et al. |
| 4,101,026 | A | | 7/1978 | Bonk |
| 4,133,457 | A | | 1/1979 | Klassen |
| 4,180,160 | A | * | 12/1979 | Ogawa et al. ..... 206/210 |
| 4,200,200 | A | | 4/1980 | Hein, III et al. |
| 4,289,262 | A | | 9/1981 | Finkelstein |
| 4,337,876 | A | | 7/1982 | Thompson |
| 4,535,912 | A | | 8/1985 | Bonk |
| 4,562,938 | A | | 1/1986 | Loder |
| 4,586,630 | A | | 5/1986 | Loder |
| 4,586,631 | A | | 5/1986 | Loder |
| 4,651,895 | A | | 3/1987 | Niske et al. |
| 4,681,240 | A | | 7/1987 | Wyant |
| 4,784,290 | A | | 11/1988 | Howard |
| 4,848,575 | A | | 7/1989 | Nakamura et al. |
| 5,316,177 | A | | 5/1994 | Boldt |
| 5,516,001 | A | | 5/1996 | Muckenfuhs et al. |
| 5,542,567 | A | | 8/1996 | Julius |
| 5,542,568 | A | | 8/1996 | Julius |
| 5,566,873 | A | | 10/1996 | Guido |
| 5,582,294 | A | | 12/1996 | Yamada |
| 5,622,281 | A | | 4/1997 | Annand |
| 5,699,912 | A | | 12/1997 | Ishikawa et al. |
| 5,704,471 | A | | 1/1998 | Yamada |
| D395,952 | S | | 7/1998 | Buczwinski et al. |
| 5,785,179 | A | | 7/1998 | Buczwinski et al. |
| D396,636 | S | | 8/1998 | Wilfong, Jr. |
| D409,086 | S | | 5/1999 | Brown et al. |
| D412,439 | S | | 8/1999 | Cormack |
| D414,637 | S | | 10/1999 | Amundson et al. |
| D416,794 | S | | 11/1999 | Cormack |
| D418,059 | S | | 12/1999 | Hill |
| 6,053,357 | A | | 4/2000 | Yoh |
| 6,152,322 | A | | 11/2000 | Marino |
| 6,164,442 | A | | 12/2000 | Stravitz |
| D443,450 | S | | 6/2001 | Ruhotas et al. |
| D445,028 | S | | 7/2001 | Grubstein |

FOREIGN PATENT DOCUMENTS

| | | |
|---|---|---|
| EP | 0 331 027 B1 | 1/1992 |
| EP | 0 644 130 A1 | 3/1995 |
| EP | 0 744 357 A1 | 11/1996 |
| EP | 0 930 243 A1 | 7/1999 |
| EP | 0 952 088 A1 | 10/1999 |
| EP | 0 953 516 A1 | 11/1999 |
| EP | 1 072 534 A1 | 1/2001 |
| GB | 793745 | 4/1956 |
| WO | WO 97/39964 A1 | 10/1997 |
| WO | WO 98/19946 A1 | 5/1998 |
| WO | WO 99/55599 A1 | 11/1999 |
| WO | WO 00/30956 A1 | 6/2000 |
| WO | WO 00/65972 A1 | 11/2000 |
| WO | WO 01/74687 A1 | 10/2001 |
| WO | WO 01/74694 A1 | 10/2001 |

OTHER PUBLICATIONS

American Society for Testing Materials (ASTM) Designation: D 790–99, "Standard Test methods for Flexural Properties of Unreinforced and Reinforced Plastics and Electrical Insulating Materials," pp. 150–158, published Feb. 2000.

American Society for Testing Materials (ASTM) Designation: D 792–98, "Standard Test methods for Density and Specific Gravity (Relative Density) of Plastics by Displacement," pp. 159–163, published Nov. 1998.

American Society for Testing Materials (ASTM) Designation: D 2240–97, "Standard Test Method for Rubber Property—Durometer Hardness," pp. 400–403, published Mar. 1997.

American Society for Testing Materials (ASTM) Designation: D 6125–97, "Standard Test Method for Bending Resistance of Paper and Paperboard (Gurley Type Tester)," pp. 885–889, published Feb. 1998.

* cited by examiner

FLEXIBLE ORIFICE FOR WET WIPES DISPENSER

BACKGROUND OF THE INVENTION

Wipes have been made from a variety of materials which can be dry or wet when used. Wet wipes can be moistened with a variety of suitable wiping solutions. Typically, wet wipes have been stacked in a container in either a folded or unfolded configuration. For example, containers or dispensers for wet wipes have been available wherein each of the wet wipes stacked in the container has been arranged in a folded configuration such as a c-folded, z-folded or quarter-folded configuration as are well known to those skilled in the art. Sometimes the folded wet wipes have also been interfolded with the wet wipes immediately above and below in the stack of wet wipes. In an alternative configuration, the wet wipes have been placed in the container in the form of a continuous web of material which includes perforations to separate the individual wet wipes and which can be wound into a roll. Such wet wipes have been used for baby wipes, hand wipes, household cleaning wipes, industrial wipes and the like.

The conventional packages which contain wipes, such as those described above, have typically been designed to be positioned on a flat surface such as a countertop, changing table or the like. Such conventional packages have generally provided a plastic container, tub or package which provides a sealed environment for the wet wipes to ensure that they do not become overly dry. Some of the conventional packages have also been configured to provide one at a time dispensing of each wet wipe which can be accomplished using a single hand after the package has been opened. Such single handed, one at a time dispensing, often referred to as "pop-up" dispensing, is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a baby wipe to clean the infant.

However, the dispensing of wipes from such conventional containers for wipes has not been completely satisfactory. For example, this is due at least in part to the orifice through which wipes within the container are dispensed. In particular, for example, this concerns the configuration and characteristics of the orifice for dispensing a stack of wipes that are separably joined to each adjacent wipe in the stack to provide pop-up dispensing once an initial wipe in the stack is dispensed through the orifice. As another example, this can concern the relationship of a group of wipes in the stack to other wipes in the stack if groups of wipes make up the stack of wipes. As yet another example, these relationships between wipes concern, in conjunction with the wipes, the container from which the wipes are dispensed and characteristics thereof. The present invention builds upon the teaching disclosed in U.S. Ser. No. 09/538,711 filed Mar. 30, 2000 entitled "WET WIPE CONTAINER WITH FLEXIBLE ORIFICE" and assigned to the assignee of the present application, which prior application is incorporated fully herein by reference.

SUMMARY OF THE INVENTION

In response to the difficulties and problems discussed above, for example, new orifice configurations and characteristics enabling improved dispensing, and which may be more cost effective and reliable (e.g., reducing the likelihood of wipe fallback and/or reducing the likelihood of multiple wipes dispensing undesirably), have been discovered. For example, dispensing can be improved or made easier when a wipe is ready for dispensing upon the opening of a resealable wipes dispenser after the initial opening of the dispenser and use of a first wipe in a plurality of wipes. That is, a portion of the wipe is positioned in an orifice of the dispenser sufficiently protruding so a user can readily grasp the same and remove the entire individual wipe without premature tearing or non-dispensing of the top wipe. As another example wipe fallback can occur when a leading wipe in a plurality of wipes separates completely from a following or trailing wipe prematurely, i.e., before a sufficient portion of the following wipe is positioned within the dispenser orifice to remain there for later dispensing after the leading wipe is fully separated or disjointed from the trailing wipe outside the dispenser. In such a fallback situation, the following wipe would need to be re-threaded through the dispensing orifice when its dispensing is next desired. This may not be undesirable if done intentionally, i.e., if maintaining a maximum moisture level for the wipes is desired and the dispensing orifice is designed to easily accommodate reach-in retrieval of the next wipe. As yet another example multiple wipes dispensing can occur when a leading individual wipe in a plurality of wipes does not timely separate completely from a following individual wipe while the following wipe is still at least partially maintained in the dispensing orifice, i.e., the following wipe dispenses completely out of the dispenser with the leading wipe causing two (or more) wipes to dispense substantially simultaneously. This can be desirable when two (or more) wipes are needed, but if only one is desired, then this is not preferred. The purposes and features of the present invention will be set forth in and are apparent from the description that follows, as well as will be learned by practice of the invention. Additional features of the invention will be realized and attained by the product and processes particularly pointed out in the written description and claims hereof, as well as from the appended drawings.

In one aspect, the invention provides a flexible orifice for pop-up style dispensing with a wet wipes dispenser. The orifice includes a flexible, rubber-like sheet having a top surface and a bottom surface. A continuous slit extends across the top and bottom surfaces of the sheet and enables a wet wipe to pass from the bottom surface to the top surface or from the top surface to the bottom surface. A first portion of the sheet has a first thickness and a second portion of the sheet located between the continuous slit and the first portion has a second thickness which is greater than or less than the first thickness.

In another aspect, the invention provides a wet wipes dispenser having a flexible orifice for pop-up style dispensing. The dispenser includes a rigid port positioned adjacent an end portion of the dispenser. The rigid port surrounds a flexible, rubber-like sheet having a top surface and a bottom surface. A continuous slit extends across the top and bottom surfaces of the sheet and enables a wet wipe to pass from the bottom surface to the top surface or from the top surface to the bottom surface. A first portion of the sheet has a first thickness and a second portion of the sheet located between the continuous slit and the first portion has a second thickness which is greater than or less than the first thickness.

In yet another aspect, the invention provides a flexible orifice for pop-up style dispensing with a wet wipes dispenser. The orifice includes a flexible, rubber-like sheet having a top surface and a bottom surface. A continuous slit extends across the top and bottom surfaces of the sheet and enables a wet wipe to pass from the bottom surface to the top surface or from the top surface to the bottom surface. At least one hinge is located between the continuous slit and a surrounding portion of the sheet wherein a side of the sheet adjacent the continuous slit can pivot relative to the surrounding portion of the sheet via the hinge.

In still another aspect, the invention provides a flexible orifice for pop-up style dispensing with a wet wipes dispenser. The orifice includes a flexible, rubber-like sheet having a top surface and a bottom surface. A continuous slit extends across the top and bottom surfaces of the sheet and enables a wet wipe to pass from the bottom surface to the top surface or from the top surface to the bottom surface. The continuous slit has at least one curved portion connected with at least one non-curved portion.

In yet another aspect, the invention provides a wet wipes dispenser having a flexible orifice for pop-up style dispensing. The dispenser includes a rigid port positioned adjacent an end portion of the dispenser, the dispenser having a longitudinal axis and a lateral axis. The rigid port surrounds a flexible, rubber-like sheet having a top surface and a bottom surface. A continuous slit extends across the top and bottom surfaces of the sheet and enables a wet wipe to pass from the bottom surface to the top surface or from the top surface to the bottom surface. The continuous slit has at least one curved portion connected with at least one non-curved portion.

In yet other aspects, the invention provides various configurations for the sheet, the continuous slit and orientations of portions of the continuous slit and of the continuous slit relative to the dispenser.

In still other aspects, the invention is provided for use in various types of dispensers and for dispensing in various manners such as reach-in dispensing and popup dispensing.

As used herein, wet wipes of the invention are considered "separably joined", "separably joining" (and variations thereof) when each wipe of a plurality, e.g., in a stack of wipes, is engaging any adjacent wipe while in the dispenser or package such that withdrawing the leading wipe through the dispenser or package opening also withdraws at least a portion of the following wipe through the opening before the leading wipe and the following wipe separate completely from each other. Such engaging of any adjacent wipe can include a non-interfolded relationship in combination with one or more of the following between adjacent wipes: adhesive, friction, cohesion, fusion bonding (e.g., ultrasonic welding, heat sealing), mechanical entanglement (e.g., needle punching, steam sealing, embossing, crimping), autogeneous bonding, and/or weakened line(s) (e.g., perforations, zones of frangibility, score line(s), crush cutting).

As used herein, when the following wipe that has at least a portion through the opening of the dispenser or package is intentionally maintained in the opening after the leading wipe is completely separated from the following wipe, this is referred to as "pop-up" format or dispensing. To be intentionally maintained in the opening means the opening is configured to so maintain the wipe therein, such as through use of a constricting orifice or opening being smaller than the wipe in at least one dimension of the wipe.

As used herein, "reach-in" dispensing is understood to mean having to fetch a wipe out of a dispenser through an opening substantially co-extensive with the walls of the dispenser or through a restricted opening smaller than the perimeter defined by the walls. In either case, the top wipe for dispensing rests on top of the remainder of the stack of wipes and the top wipe needs to be separated from the remainder of the stack each time anew when dispensing is desired. An example of a reach-in dispenser is found in the currently available baby wipes product sold by Kimberly-Clark Corporation of Neenah, Wis. under the trade name HUGGIES® Supreme Care.

As used herein, the term "rigid" is used to mean a level of stiffness commonly associated with materials used to manufacture wet wipes tubs. Numerically, these materials typically have a flexural modulus (as measured in accordance with ASTM D790 "Standard Test Method for Flexural Properties of Unreinforced and Reinforced Plastics and Electrical Insulating Materials") of about 500 Newtons per square millimeter or greater, more specifically from about 1100 to about 1550 Newtons per square millimeter.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the wipes of the invention. Together with the description, the drawings serve to explain the various aspects of the invention.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts depicted in the drawings are referred to by the same reference numerals.

DETAILED DESCRIPTION OF THE INVENTION

As a result of their work, the inventors have determined that particular dispenser orifice configurations and characteristics are better than others for overcoming some challenges to successively dispensing wet wipes one at a time more successfully. Such can be beneficial to, e.g., easier wipe retrieval, reducing the likelihood of wipe fallback into the dispenser and/or reducing the likelihood of multiple wipes dispensing when only a single wipe is desired, and the balancing/interaction of these features. That is, the inventors believe they have discovered new ways to better accommodate the variable forces experienced during dispensing. Such forces are due to variability in the characteristics of the basesheet which makes up the wipes, add-on levels for the wet wipes, and variability in the separably joined relationship between adjacent wet wipes in a stack of wet wipes.

Figure 1:
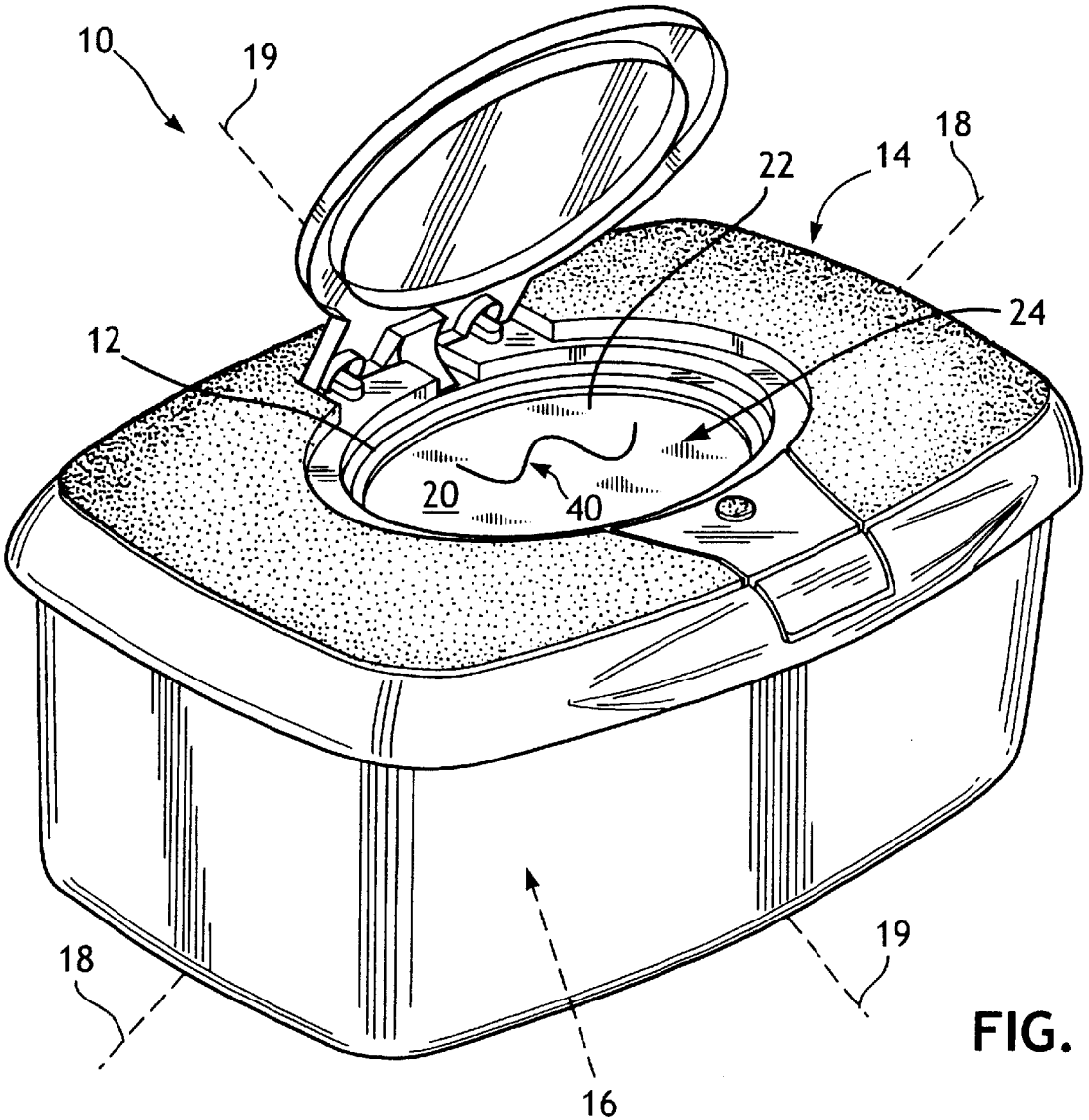
FIG. 1 representatively shows a flexible orifice for pop-up style dispensing with a wet wipes dispenser, in accordance with the present invention.
Figure 2:
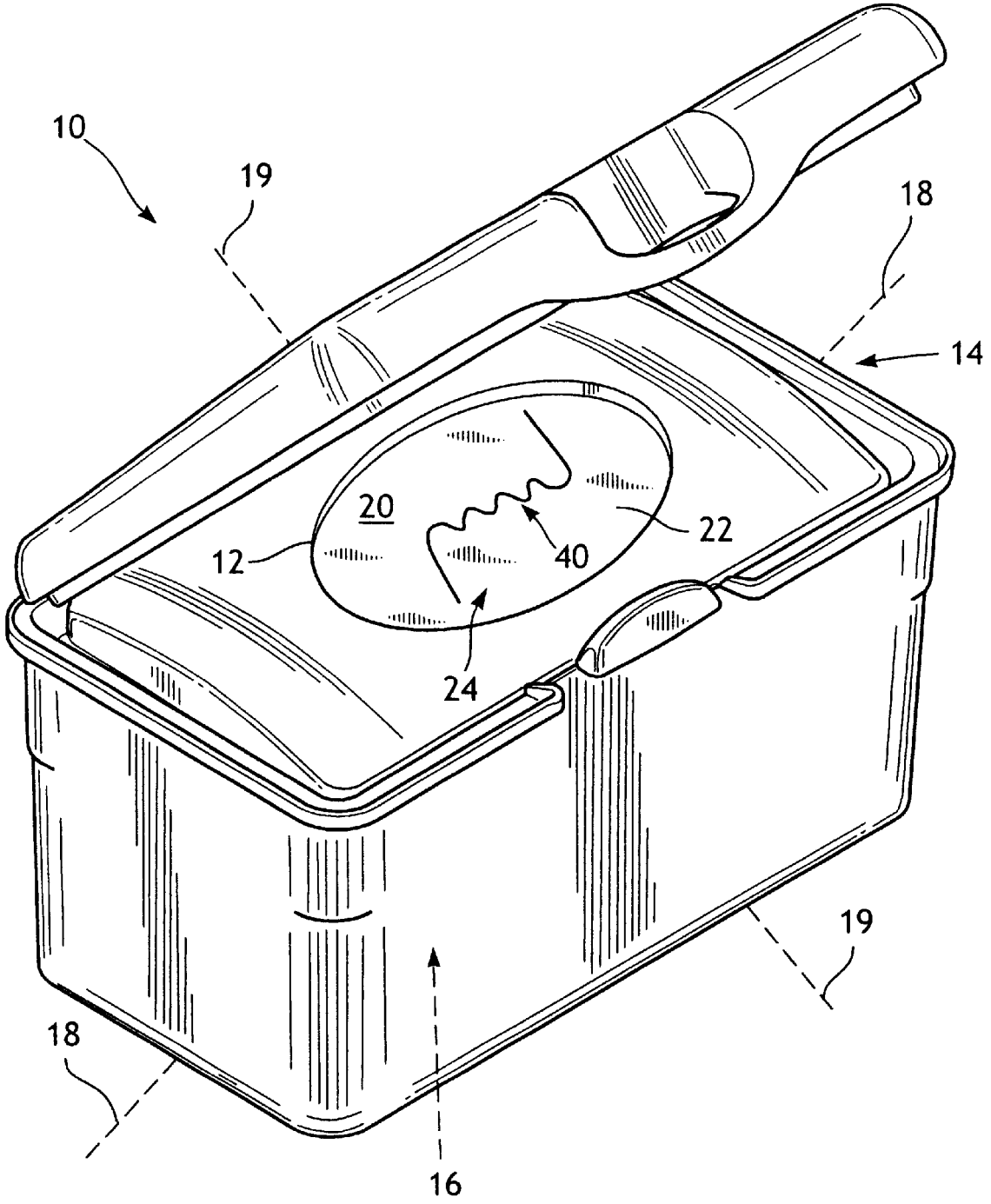
FIG. 2 representatively shows an alternate flexible orifice for pop-up style dispensing with an alternate wet wipes dispenser, in accordance with the present invention.
Figure 3:
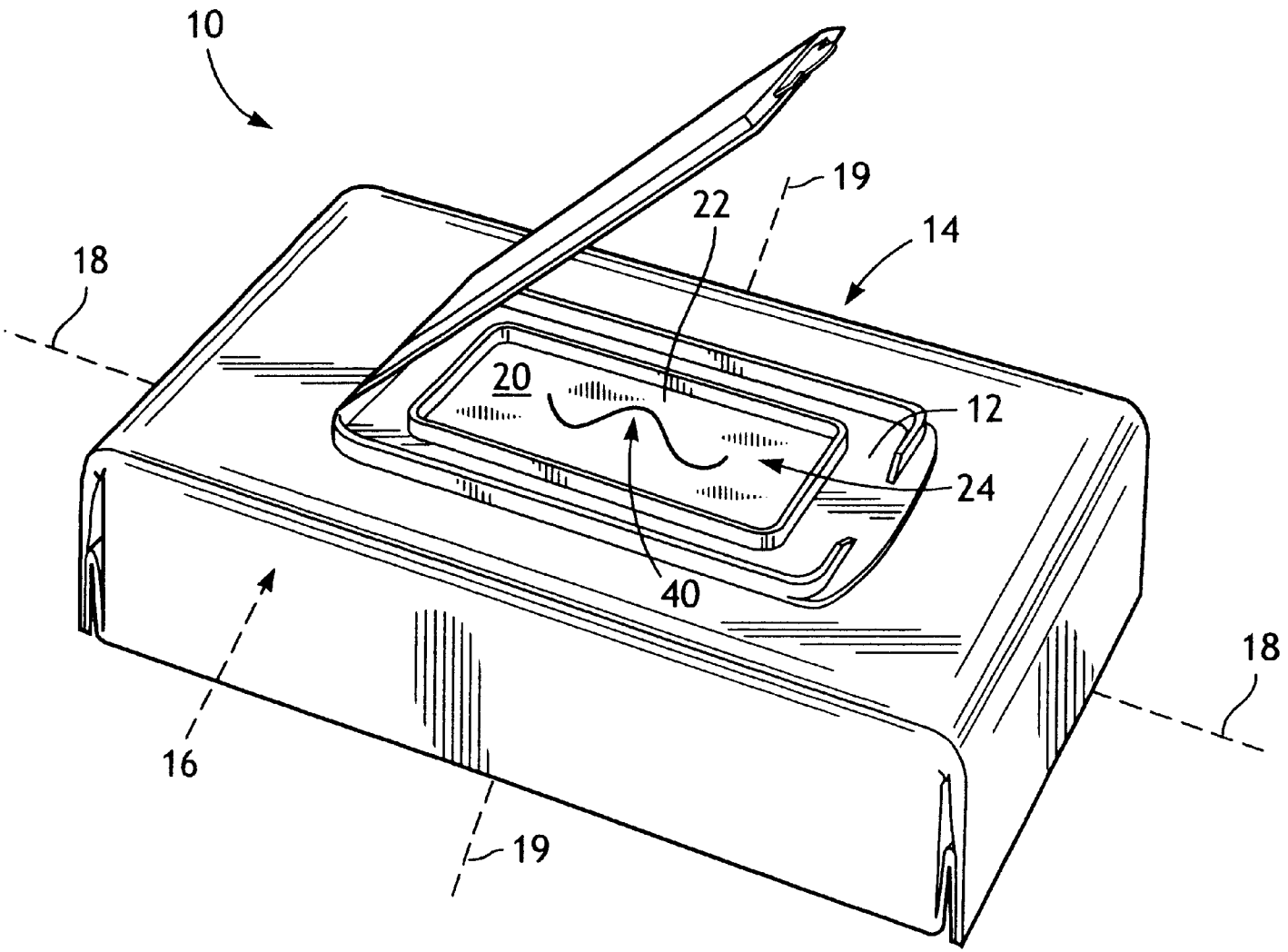
FIG. 3 representatively shows a flexible orifice like that of FIG. 1 but with an alternate wet wipes dispenser, in accordance with the present invention.

As representatively illustrated throughout the figures, and for explanation now referring to FIGS. 1–3, there are depicted various wet wipes dispensers 10 having a flexible orifice 20 for pop-up style dispensing of wet wipes. A rigid port 12 can be positioned adjacent an end portion 14 of the dispenser 10. The rigid port 12 surrounds a flexible, rubber-like sheet 22 having a top surface 24 and a bottom surface 26 (FIGS. 5–10). A continuous slit 40 extends across the top and bottom surfaces 24, 26 of the sheet 22 and between the surfaces 24, 26 so that a wet wipe in a stack of wet wipes 16 can pass from the bottom surface 26 to the top surface 24 or from the top surface to the bottom surface. As seen in FIGS. 4–10, a first portion 28 or surrounding portion 28 of the sheet can have a first thickness. A second portion 32 of the sheet located between the continuous slit 40 and the first portion 28 can have a second thickness which is greater than or less than the first thickness.

With reference to FIGS. 4–10, the second portion 32 can be located adjacent the continuous slit 40. The second portion can be located on one side of the slit 40 or on both opposing sides of the continuous slit. The second portion 32 can extend along only a portion of the continuous slit or its entire length. The continuous slit can have one or more curved portion such as a first curved portion 44 and a second curved portion 48. The first curved portion can have a first orientation relative to a longitudinal axis 42 of the continuous slit. The second curved portion can have a second orientation relative to the longitudinal axis 42. The first orientation can be different than the second orientation, and particularly, the first orientation can be an inverse of the second orientation relative to the longitudinal axis of the slit 42. The continuous slit 40 can have an orientation pattern along its length of A-B-A, such as the convex-concave-convex pattern seen in FIG. 4 relative to the longitudinal axis 42. More particularly, the continuous slit 40 can have an orientation pattern approximating that of a sine wave. The continuous slit can form two sides 52 substantially uniformly spaced apart from each other along the continuous slit. More particularly, the two sides 52 can be spaced apart from each other by a distance equal to or less than about 20 mils.

With reference to FIGS. 7–10, in one aspect of the invention the flexible orifice has at least one hinge 56 located between the continuous slit 40 and a surrounding portion 28 of the sheet 22. In this way, the side 52 of the sheet adjacent the continuous slit can pivot relative to the surrounding portion of the sheet via the hinge. The hinge 56 is formed by any structural deformation or recess that creates a stress release zone for flexing of a portion of the sheet 22, e.g., the side or sides 52, at the hinge or hinges 56 relative to the adjacent portion of the sheet. A hinge 56 can be located adjacent the continuous slit on opposing sides 52 of the continuous slit. Also, the hinge can extend along the entire slit 40 or only a portion of the continuous slit.

Figure 11:
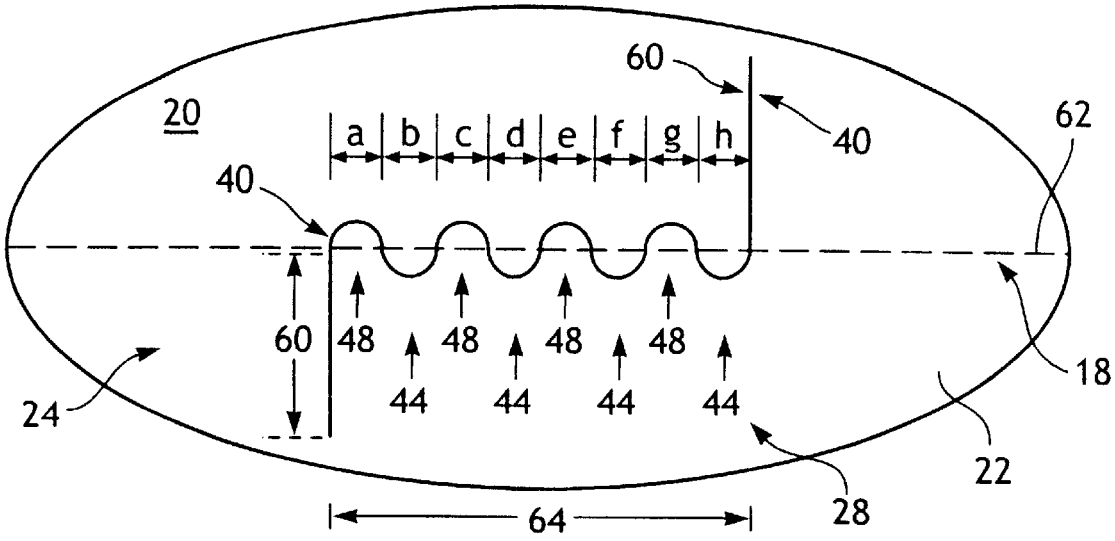
FIG. 11 representatively shows an enlarged view of the flexible orifice of FIG. 2.

With reference to FIGS. 11–14, other aspects of the invention are disclosed. For example, the continuous slit can have at least one non-curved portion 60 connected with at least one curved portion such as curved portions 44 and 48. The curved portions 44 and 48 in these Figures can be the same or similar to the curved portions in FIG. 4. More particularly, the curved portions 44 and 48 in FIGS. 11–13 can be half circles that have inverse orientations relative to one another. In another aspect, the curved portions 44, 48 can have a first diameter for curvature and a second diameter for curvature adjacent the first diameter which is different than the first diameter. In FIG. 11 this could be curved portions a and h and having a different or larger diameter than those of portions b, c, d, e, f and g. The curved portions 44, 48 can have two non-curved portions 60 connected adjacent opposite ends of the respective curved portions 44, 48. The non-curved portions 60 can extend away from each other relative to the longitudinal axis 62 of the curved portion of the slit 40 connecting the two non-curved portions 60. The non-curved portions 60 can be slightly arced and, more particularly, straight. Similar to the slit 40 seen in FIG. 4, the slit 40 in FIGS. 11–13 can be formed with two sides 52 substantially uniform spaced apart from each other along the continuous slit, and more particularly, with the two sides spaced apart from each other by a distance equal to or less than about 20 mils.

Figure 12:
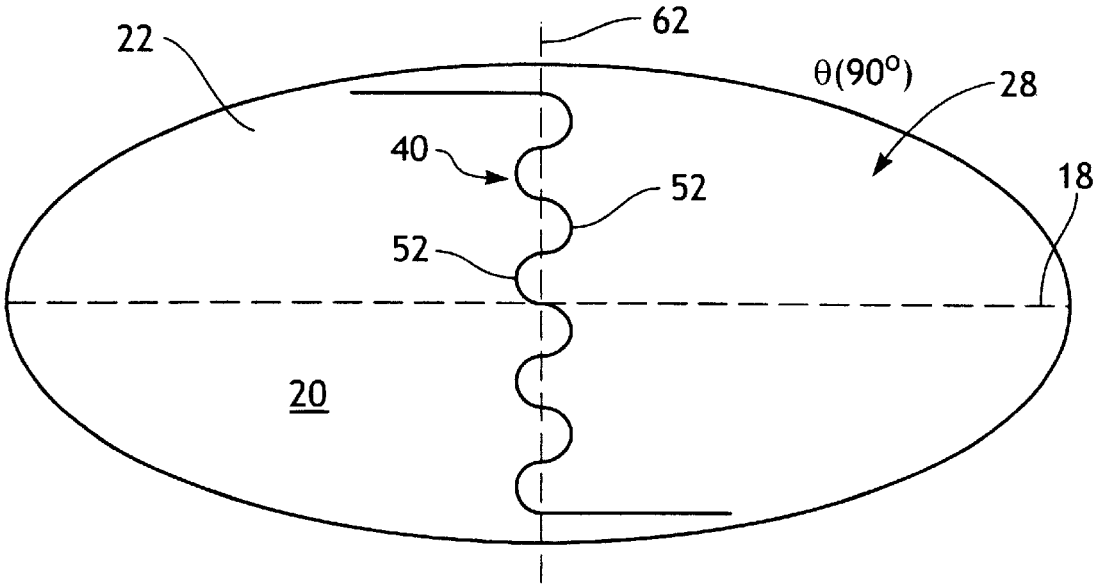
FIG. 12 representatively shows an enlarged view of the flexible orifice of FIG. 12, but orientated at a 90 degree angle relative to the orifice of FIG. 11.
Figure 13:
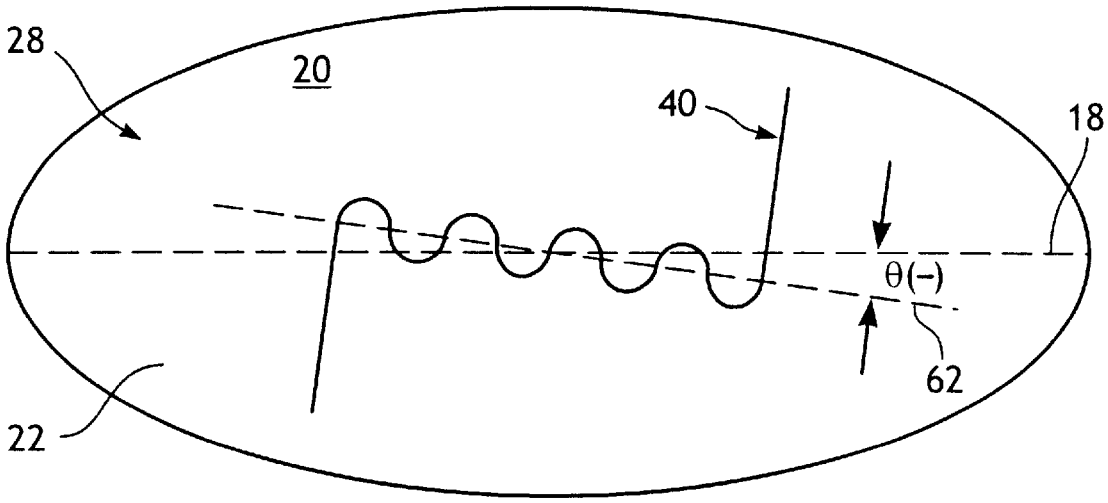
FIG. 13 representatively shows an enlarged view of the flexible orifice of FIG. 12, but orientated at a negative degree angle relative to the orifice of FIG. 11.
Figure 14:
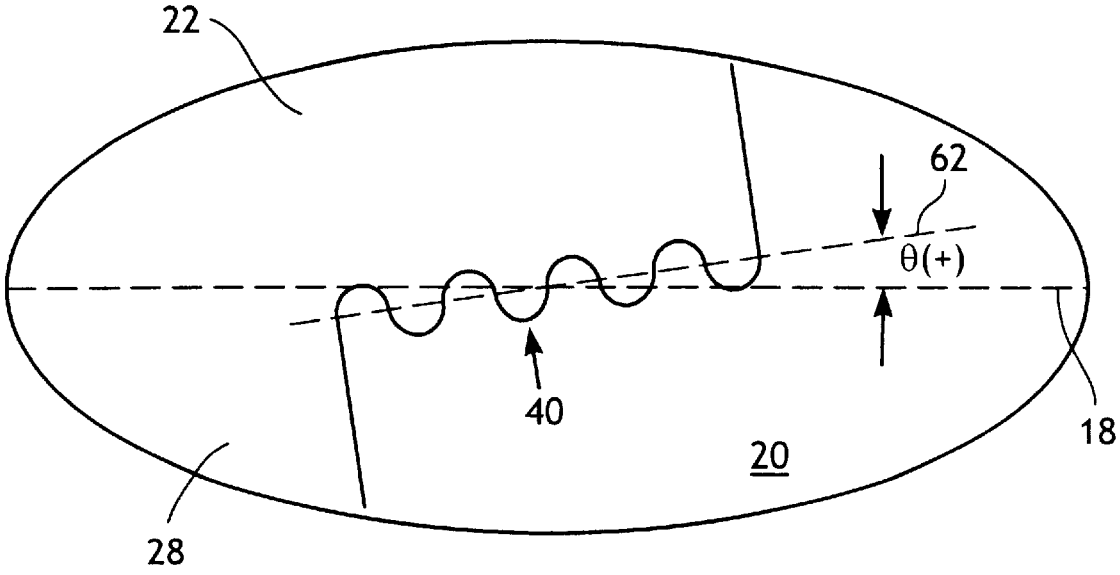
FIG. 14 representatively shows an enlarged view of the flexible orifice of FIG. 12, but orientated at a positive degree angle relative to the orifice of FIG. 11.

Still referring to FIGS. 11–13, other aspects of the invention are disclosed. For example, the inventors have discovered that the orientation of the longitudinal axis 62 of the curved portion relative to the longitudinal axis 18 of the dispenser (i.e., which defines the longitudinal axis of the stack of wipes 16 within the dispenser) surprisingly affects the dispensing force that flexible orifice 20 can have. In this regard, for example, the longitudinal axis 62 of the curved portion can be oriented non-parallel relative to the longitudinal axis 18 of the dispenser. In FIG. 11 the longitudinal axes 62 and 18 are parallel and thus represent the same axis line. In FIGS. 12–14 this is not the case and thus two different axis lines are labeled. As seen in FIGS. 12–14, more particularly, the inventors have discovered that the orientation between the axes 62 and 18 can advantageously be, in order of increasing advantage, between negative 90 degrees and 90 degrees; between negative 45 degrees and 45 degrees; or between negative 20 degrees and 20 degrees.

Figure 4:
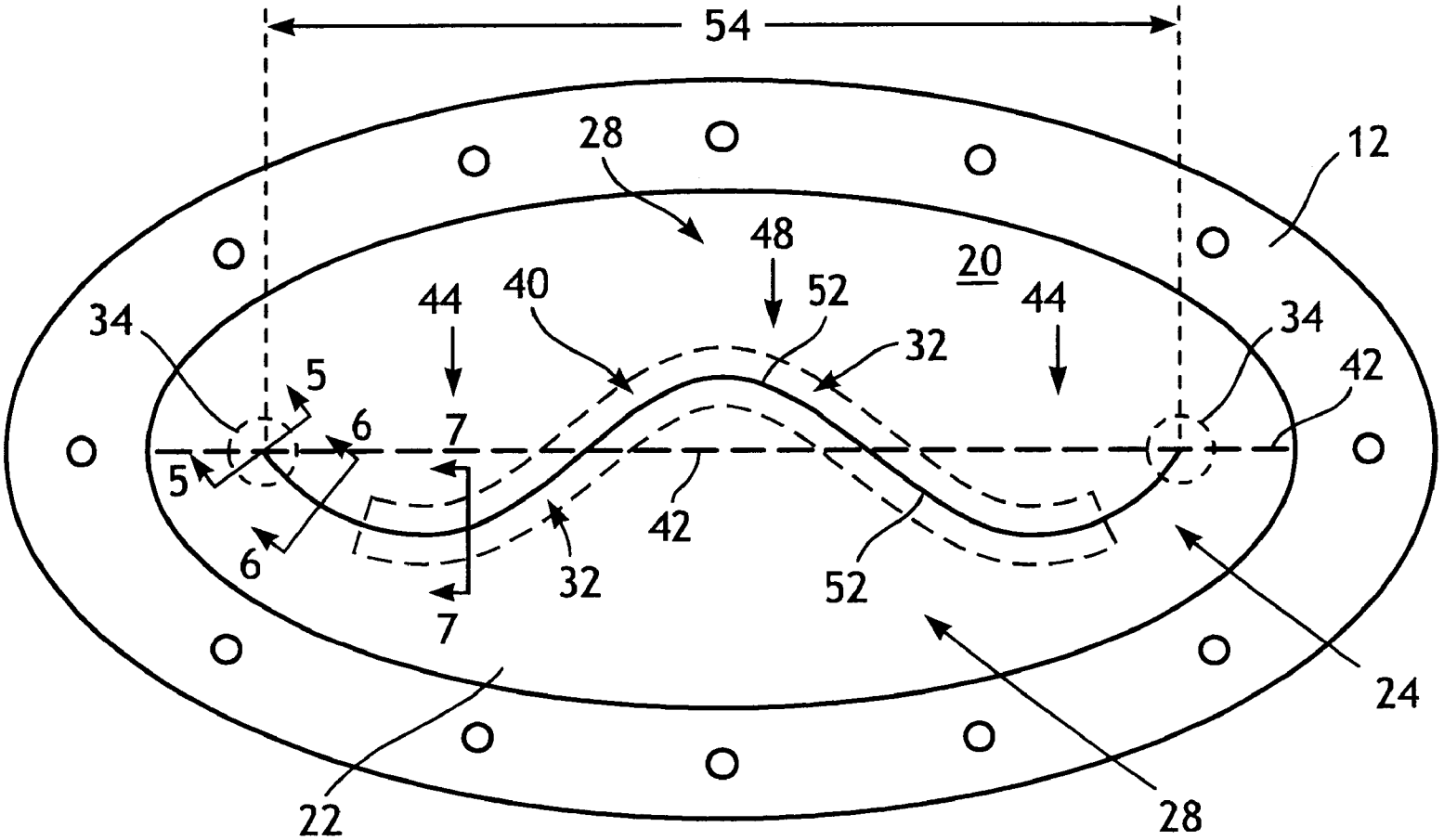
FIG. 4 representatively shows an enlarged view of the flexible orifice of FIG. 1 in combination with a rigid collar for attaching to the dispenser.
Figure 5:
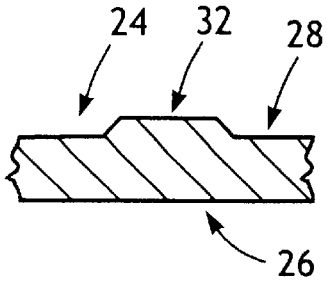
FIG. 5 representatively shows an enlarged cross sectional view of a sheet portion of the flexible orifice, taken along the line 5—5.
Figure 6:
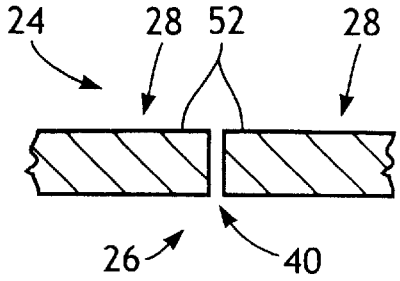
FIG. 6 representatively shows an enlarged cross sectional view of a sheet portion of the flexible orifice, taken along the line 6—6.
Figure 7:
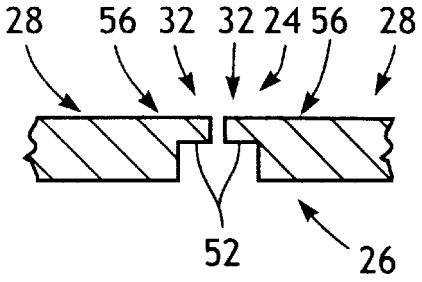
FIG. 7 representatively shows an enlarged cross sectional view of a sheet portion of the flexible orifice, taken along the line 7—7.
Figure 8:
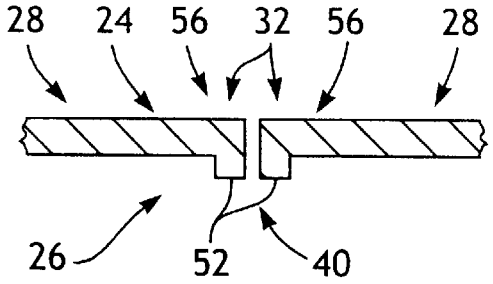
FIG. 8 representatively shows an enlarged cross sectional view of an alternate sheet portion of a flexible orifice, similar to the view in FIG. 7 taken along the line 7—7.
Figure 9:
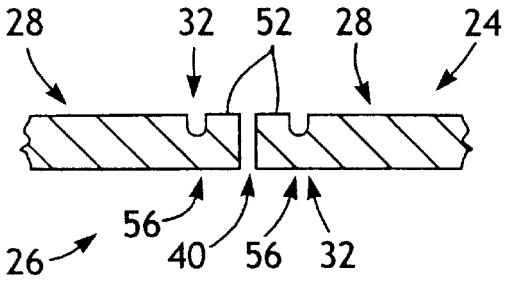
FIG. 9 representatively shows an enlarged cross sectional view of yet another alternate sheet portion of a flexible orifice, similar to the view in FIG. 7 taken along the line 7—7.
Figure 10:
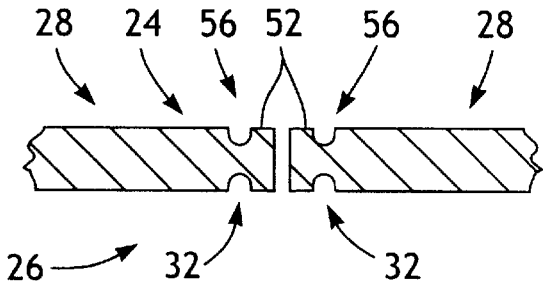
FIG. 10 representatively shows an enlarged cross sectional view of still another alternate sheet portion of a flexible orifice, similar to the view in FIG. 7 taken along the line 7—7.

With reference to FIGS. 4 and 11, a variety of particular characteristics can be employed to achieve a desired dispensing force for the flexible orifice. Often, this is dependent upon the configuration of the continuous slit and configuration of the flexible, rubber-like sheet, as well as the material properties of the flexible, rubber-like sheet and material characteristics of the wet wipes being dispensed (e.g., (e.g., fiber composition, formation process, bulk, density, thickness, weight, CD tensile, MD tensile and type of separably joined relationship between adjacent wipes in a stack of wipes). Some examples are now discussed to help guide practice of the invention and without limitation to the specifics set forth. For example, the rigid port can have a longitudinal axis (e.g., the long axis of the oval) with a length of about 10% to about 95% of the width of a wet wipe, and more particularly of about 60% to about 90% of the width of a wet wipe. In a similar regard, the rigid port can have a lateral axis (e.g., the short axis of the oval) with a length of about 10% to about 90% of the length of the longitudinal axis, and more particularly of about 30% to about 60% of the length of the longitudinal axis.

Referring specifically to FIG. 4, other examples are discussed. The continuous slit can have an orientation pattern of a sine wave with a half cycle, one cycle, one and half cycles, two cycles, or more depending on the overall desired length 54 of the slit. The amplitude of the curved portion can be from about 0.1 inch to about 1 inch and more particularly about 12 inch. The length 54 of the continuous slit can be from about 20% to about 90% of the width of a wipe and more particularly from about 40% to about 70% of the width of a wipe. The width of the second portion 32 of each side 52 of the slit can be about 1/16 inch to about ½ inch and more particularly from about ⅛ inch to about ¼ inch. The length of the second portion 32 can be about 10% to about 95% of the length 54 of the orifice and more particularly about 60% to about 80% of the length 54. The thickness of the first portion 28 or surrounding portion 28 can be about 20 mil to about 110 mil and more particularly about 35 mil to about 60 mil, e.g., about 50 mil. The thickness of the second portion 32 can be about 20% to about 90% of the thickness of the first portion 28, e.g., about 40 mil. The thickness at the end of continuous slit 40 at the zone 34 (e.g., seen in FIG. 5) can be about 100% to about 300% of the thickness of the first portion 28.

Referring specifically to FIG. 11, still other examples are discussed. The width 64 of the continuous slit can be about 15% to about 70% of the width of a wipe and more particularly about 25% to about 45% of the width of a wipe. The radius of the curved portions, e.g., half cycles a to g, can be about ⅛ inch to about ½ inch and more particularly about ¼ inch to about 5/16 inch. The radius may vary from one curved portion to another with each outer radius, e.g., radius a and d, being about 25% larger that the other curved portions. The length of the non-curved portion 60 can be about ½ inch to about 1.5 inches and more particularly about 0.8 inches to about 1.2 inches. The thickness of the flexible, rubber-like sheet 22 can be uniform across with a thickness of about 10 mil to about 110 mil and more particularly about 35 mil to about 60 mil. Alternately, the thickness of the sheet 22 in FIG. 11 can be of varying thickness like the sheet 22 in FIG. 4.

In an effort to quantify the properties of the flexible rubber-like sheet 22, the relevant material properties can be described in terms of the hardness, stiffness, thickness, elasticity, specific gravity, compression set, and any combination thereof. More specifically, the Shore A hardness (as measured by ASTM D2240) of the flexible, rubber-like sheet or material can be about 100 or less, more specifically from about 20 to about 90, and still more specifically from about 40 to about 80, and yet more specifically from about 60 to about 70. The Gurley stiffness of the flexible, rubber-like sheet or material (as measured by ASTM D 6125-97 "Standard Test Method for Bending Resistance of Paper and Paperboard") can be about 10,000 milligrams of force (mgf) or less, more specifically from about 100 to about 8000 mgf, more specifically from about 200 to about 6500 mgf, and still more specifically from about 300 to about 1500 mgf. The thickness of the flexible, rubber-like sheet can be about 10 mil or greater, more specifically from about 10 mil to about 110 mil, and still more specifically from about 35 mil to about 60 mil. The elasticity of the flexible rubber-like material or sheet, as characterized by the tensile stress at 100 percent elongation and measured in accordance with ASTM D412 "Standard Test Methods for Vulcanized Rubber and Thermoplastic Elastomers", can be about 10 megapascals (MPa) or less, more specifically from about 0.1 to about 7 MPa, and still more specifically from about 0.5 to about 2.5 MPa. The flexible rubber-like sheet can have a specific gravity (per ASTM D792) of about 0.80 to 1.21, more specifically 0.88 to about 1.10, and still more specifically from about 0.90 to about 1.0. The flexible rubber-like sheet can have a compression set (per ASTM 395B) of (at room temperature/at 70 degrees C.) about 8/30 to 40/120 and more specifically 15/45 to about 28/100.

An example of some such flexible sheet-like materials include thermoplastic elastomeric (TPE) materials that can be used to provide acceptable dispensing. Materials which can be employed include (but are not limited to): any of the family of styrenic-based TPE's (i.e. styrenic block copolymer compounds); styrenic-based TPE's containing rubber modifiers such as Kraton™, Santoprene™, or other rubber modifiers; Kraton™; Santoprene™; specialty copolymers, such as ethylene-methyl acrylate copolymers (e.g. EMAC™ of the Eastman Chemical Company); thermoset rubbers; polyurethane; alloys; amides; engineering TPE's; olefinic-based; olefinic vulcanizates; polyester-based; polyurethane-based. One such material for the flexible, rubber-like sheet could be that manufactured by the GLS Corporation of McHenry, Ill., USA and known as resin #G2701. The G2701 material is one of the resins in the product family of TPEs. G2701 is a styrenic-based material and is in the family of Styrenic block copolymer compounds. Some particular properties of the G2701 can be: specific gravity of 0.090 g/cc (per ASTM D792); hardness (Shore A durometer) of 68 (ASTM D2240); and compression set of 24% at room temperature, 96% at 70 deg. C. (per ASTM 395B). Another similar material is known as G2755 and also sold by GLS Corporation. In addition, a lubricant (e.g., wax) can be added to lower the coefficient of friction of the continuous slit which can benefit injection molding, wet wipes dispensing, and physical handling of the flexible orifice. The G2701 TPE resin with ¼% wax additive sold by GLS Corporation and known as #LC217-189 can be used.

Wipes for use with the present invention, e.g., wet wipes, can be arranged in a package or dispenser in any manner which provides convenient and reliable one at a time dispensing and which assists the wet wipes in not becoming overly dry. For example, the wet wipes can be arranged in a dispenser or package as a plurality of individual wipes arranged in a stacked configuration to provide a stack of wet wipes which may or may not be individually folded. The wet wipes can be individual wet wipes which are folded in a c-fold configuration, z-fold configuration, connected to adjacent wipes by a weakened line or other non-interfolded configurations as are known to those skilled in the art. Alternatively, the individual wet wipes can be interfolded such that the leading and trailing end edges of successive wipes in the stacked configuration overlap. In each of these non-interfolded and interfolded configurations, the leading end edge of the following wet wipe is loosened from the stack by the trailing end edge of the leading wet wipe as the leading wet wipe is removed by the user from the dispenser or package. For example, representative wet wipes for use with the invention are described in a U.S. patent application filed separately but concurrently herewith entitled, "PROCESS FOR JOINING WET WIPES TOGETHER AND PRODUCT MADE THEREBY" of inventors Yung H. Huang et al., U.S. Ser. No. 09/870,815, assigned to the same assignee of this application and known by attorney docket number 15,991, which application is incorporated herein by reference, as well as, in a US patent application filed separately but concurrently herewith entitled, "STACK OF FAN FOLDED MATERIAL AND COMBINATIONS THEREOF" of inventor Gerald K. Sosalla, U.S. Ser. No. 09/871,019, assigned to the same assignee of this application and known by attorney docket number 16214A, which application is incorporate fully herein by reference.

The flexible orifice of the present invention can be used with a variety of dispensers. An example of some such dispensers are seen in FIGS. 1–3. FIGS. 1 and 2 show wet wipe dispensers having rigid plastic containers. FIG. 3 shows a wet wipes dispenser having a flexible container (e.g., a form, fill seal type of film container) with a rigid port member attached thereto. Each dispenser includes a top hingedly attached adjacent an end portion of the dispenser. In FIGS. 1 and 2, the dispensers have a removable cover which contains the rigid port 12 which surrounds the flexible, rubber-like sheet 22. The cover can be fixedly or removably secured to the sidewalls of the base. For each dispenser in FIGS. 1–3, the top is secured in a closed position by a suitable latching mechanism. The shape of the rigid port in the dispensers shown in FIGS. 1 and 2 is oval and in FIG. 3 rectangular, but such port (i.e., and thus the flexible orifice contained within the port 12) can be any shape and size large enough to enable some clearance between the ends of the continuous slit and the rigid port so as to not interfere with the dispensing function of the flexible orifice.

In use, the top of the dispenser is opened and then access to the flexible orifice is gained. The user then passes his or her hand, etc., through the continuous slit 40 to grab the first wipe in the stack of wipes 16. If the orifice is a frangible seal, this must be broken before the user can pass his or her hand through the orifice. Once the user grabs the wipe, it can then pass through the orifice and out of the dispenser as the user pulls it up. If the user does not immediately need the wipe, it can be left in the orifice partially dispensed where it can be maintained in place by the continuous slit until desired later. The partially dispensed wipe will just rest in place in the orifice, part inside the dispenser and part in the space between the top and the flexible orifice, conveniently ready for later dispensing in the pop-up format. If the user does immediately desire to use the wipe, it can pass the complete wipe through the continuous slit and out of the dispenser. For pop-up dispensing, the wipe will become separated or disjointed from the subsequent adjacent second wipe at a separably joined interface (e.g., weakened line, adhesive joint, or other mechanism) after fully dispensing the first wipe and while a portion of the second wipe remains in the flexible orifice 20. The next wipe for dispensing may be automatically maintained in the orifice partially dispensed for later use (i.e., in a pop-up dispensing format). Alternatively, the following wipe may need to be fetched out of the inside of the dispenser similar to the first wipe at a later time when it is desired, commonly called reach-in dispensing, if the user pushed the following wipe back into the storage portion after pop-up dispensing of the leading wipe. In either case, after the desired number of wipes are taken, the top can be closed, with or without a wipe partially dispensed in the flexible orifice, as discussed previously. At a later time when another wipe(s) is desired, the preceding steps can generally be followed again.

All publications, patents, and patent documents cited in the specification are incorporated by reference herein, as though individually incorporated by reference. In the case of any inconsistencies, the present disclosure, including any definitions herein, will prevail. While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

What is claimed is:

1. A flexible orifice for pop-up style dispensing with a wet wipes dispenser comprising:

a flexible, rubber-like sheet having a top surface and a bottom surface;

a continuous slit extending across the top and bottom surfaces of the sheet and through which a wet wipe can pass from the bottom surface to the top surface or from the top surface to the bottom surface; and the continuous slit having at least one curved portion connected with at least one non-curved portion.

2. The orifice of claim 1 wherein the curved portion has a first orientation relative to a longitudinal axis of the continuous slit and a second orientation relative to a longitudinal axis of the continuous slit wherein the first orientation is different than the second orientation.

3. The orifice of claim 2 wherein the first orientation is an inverse of the second orientation.

4. The orifice of claim 2 wherein the curved portion has at least one orientation pattern along its length of A-B.

5. The orifice of claim 2 wherein the curved portion has an orientation pattern approximating that of a sine wave.

6. The orifice of claim 1 wherein the curved portion has a first diameter for curvature adjacent the non-curved portion and a second diameter for curvature adjacent the first diameter which is different than the first diameter.

7. The orifice of claim 5 wherein the first diameter is greater than the second diameter.

8. The orifice of claim 1 wherein the curved portion has two non-curved portions, with each non-curved portion connected adjacent opposite ends of the curved portion.

9. The orifice of claim 8 wherein the non-curved portions extend away from each other relative to a longitudinal axis of the curved portion connecting the two non-curved portions.

10. The orifice of claim 1 wherein the non-curved portion is straight.

11. The orifice of claim 1 wherein the continuous slit forms two sides substantially uniform spaced apart from each other along the continuous slit.

12. The orifice of claim 1 wherein the two sides are spaced apart from each other by a distance equal to or less than about 20 mils.

13. A wet wipes dispenser having a flexible orifice for pop-up style dispensing comprising:

a rigid port positioned adjacent an end portion of the dispenser, the dispenser having a longitudinal axis and a lateral axis;

the rigid port surrounding a flexible, rubber-like sheet having a top surface and a bottom surface;

a continuous slit extending across the top and bottom surfaces of the sheet and through which a wet wipe can pass from the bottom surface to the top surface or from the top surface to the bottom surface; and the continuous slit having at least one curved portion connected with at least one non-curved portion.

14. The dispenser of claim 13 wherein the curved portion has a first orientation relative to a longitudinal axis of the continuous slit and a second orientation relative to a longitudinal axis of the continuous slit wherein the first orientation is different than the second orientation.

15. The dispenser of claim 13 wherein the curved portion has a longitudinal axis and the longitudinal axis of the curved portion is oriented non-parallel relative to the longitudinal axis of the dispenser.

16. The dispenser of claim 13 wherein the longitudinal axis of the curved portion is oriented between −90 degrees to less than 0 degrees or greater than 0 degrees to 90 degrees relative to the longitudinal axis of the dispenser.

17. The dispenser of claim 13 wherein the longitudinal axis of the curved portion is oriented between −45 degrees to less than 0 degrees or greater than 0 degrees to 45 degrees relative to the longitudinal axis of the dispenser.

18. The dispenser of claim 13 wherein the longitudinal axis of the curved portion is oriented between −20 degrees to less than 0 degrees or greater than 0 degrees to 20 degrees relative to the longitudinal axis of the dispenser.

19. The dispenser of claim 13 wherein the curved portion is connected adjacent two non-curved portions, with each non-curved portion connected adjacent opposite ends of the curved portion.

20. The dispenser of claim 19 wherein the non-curved portions extend away from each other relative to a longitudinal axis of the curved portion connecting the two non-curved portions.

21. The dispenser of claim 13 wherein the non-curved portion is straight.

22. The dispenser of claim 13 wherein the continuous slit forms two sides substantially uniformly spaced apart from each other along the continuous slit.

23. The dispenser of claim 22 wherein the two sides are spaced apart from each other by a distance equal to or less than about 20 mils.

24. A flexible orifice for pop-up style dispensing with a wet wipes dispenser comprising:

a flexible, rubber-like sheet having a top surface and a bottom surface;

a continuous slit extending across the top and bottom surfaces of the sheet and Through which a wet wipe can pass from the bottom surface to the top surface or from the top surface to the bottom surface; and the continuous slit having at least one curved portion connected with at least one non-curved portion wherein the curved portion has a first diameter for curvature adjacent the non-curved portion and a second diameter for curvature adjacent the first diameter which is different than the first diameter.

25. The dispenser of claim 24 wherein the first diameter is greater than the second diameter.

26. The dispenser of claim 24 wherein the curved portion has a first orientation relative to a longitudinal axis of the continuous slit and a second orientation relative to a longitudinal axis of the continuous slit wherein the first orientation is an inverse of the second orientation and the curved portion has at least one orientation pattern of A-B along its length.

27. The dispenser of claim 24 wherein the curved portion has two non-curved portions, with each non-curved portion connected adjacent opposite ends of the coned portion and the non-curved portions extending away from each other relative to a longitudinal axis of the curved portion connecting the two non-curved portions.

28. The dispenser of claim 24 wherein the longitudinal axis of the curved portion is oriented between −20 degrees to less than 0 degrees or greater than 0 degrees to 20 degrees relative to the longitudinal axis of the dispenser.

29. A flexible orifice for pap-up style dispensing with a wet wipes dispenser comprising:

a flexible, rubber-like sheet having a top surface and a bottom surface;

a continuous slit extending across the top and bottom surfaces of the sheet and through which a wet wipe can pass from the bottom surface to the top surface or from the top surface to the bottom surface; and the continuous slit having at least one curved portion connected with at least one non-curved portion wherein the curved portion has two non-curved portions, with each non-curved portion connected adjacent opposite ends of the curved portion.

30. The dispenser of claim 29 wherein the non-curved portions extend away from each other relative to a longitudinal axis of the curved portion connecting the two non-curved portions.

31. The dispenser of claim 29 wherein the longitudinal axis of the curved portion is oriented between −20 degrees to less than 0 degrees or greater than 0 degrees to 20 degrees relative to the longitudinal axis of the dispenser.

32. A wet wipes dispenser having a flexible orifice for pop-up style dispensing comprising:

a rigid port positioned adjacent an end portion of the dispenser, the dispenser having a longitudinal axis and a lateral axis;

the rigid port surrounding a flexible, rubber-like sheet having a top surface and a bottom surface;

a continuous slit extending across the top and bottom surfaces of the sheet and through which a wet wipe can pass from the bottom surface to the top surface or from the top surface to the bottom surface; and the continuous slit having at least one curved portion connected with at least one non-curved portion wherein the longitudinal axis of the curved portion is oriented between −45 degrees to less than 0 degrees or greater than 0 degrees to 45 degrees relative to the longitudinal axis of the dispenser.

33. The dispenser of claim 32 wherein the longitudinal axis of the curved portion is oriented between −20 degrees to less than 0 degrees or greater than 0 degrees to 20 degrees relative to the longitudinal axis of the dispenser.

34. A wet wipes dispenser having a flexible orifice for pop-up style dispensing comprising:

a rigid port positioned adjacent an end portion of the dispenser, the dispenser having a longitudinal axis and a lateral axis;

the rigid port surrounding a flexible, rubber-like sheet having a top surface and a bottom surface;

a continuous slit extending across the top and bottom surfaces of the sheet and through which a wet wipe can pass from the bottom surface to the top surface or from the top surface to the bottom surface; and the continuous slit having at least one curved portion connected with at least one non-curved portion wherein the curved portion is connected adjacent two non-curved portions, with each non-curved portion connected adjacent apposite ends of the curved portion.

35. The dispenser of claim 34 wherein the non-curved portions extend away from each other relative to a longitudinal axis of the curved portion connecting the two non-curved portions.

36. A wet wipes dispenser having a flexible orifice for pop-up style dispensing comprising:

a rigid port positioned adjacent an end portion of the dispenser, the dispenser having a longitudinal axis and a lateral axis;

the rigid port surrounding a flexible, rubber-like sheet having a top surface and a bottom surface;

a continuous slit extending across the top and bottom surfaces of the sheet and through which a wet wipe can pass from the bottom surface to the top surface or from the top surface to the bottom surface; and the continuous slit having at least one curved portion connected with at least one non-curved portion wherein the curved portion is connected adjacent two non-curved portions, with each non-curved portion connected adjacent opposite ends of the curved portion and wherein the non-curved portions extend away from each other relative to a longitudinal axis of the curved portion connecting the two non-curved portions and wherein the curved portions have a first diameter for curvature adjacent the non-curved portions and a second diameter for curvature adjacent the first diameter which is different than the first diameter.

37. The dispenser of claim 36 wherein the longitudinal axis of the curved portion is oriented between −20 degrees to less than 0 degrees or greater than 0 degrees to 20 degrees relative to the longitudinal axis of the dispenser.

* * * * *